US006919846B2

(12) United States Patent
Koch et al.

(10) Patent No.: US 6,919,846 B2
(45) Date of Patent: Jul. 19, 2005

(54) SLOT ANTENNA FOR ARTILLERY AMMUNITION

(75) Inventors: Volker Koch, Rückersdorf (DE); Martin Hertel, Lauf (DE)

(73) Assignee: Diehl Munitionssysteme GmbH & Co., Rothenbach (DE)

( * ) Notice: Subject to any disclaimer, the term of this patent is extended or adjusted under 35 U.S.C. 154(b) by 0 days.

(21) Appl. No.: 10/485,083

(22) PCT Filed: Oct. 17, 2001

(86) PCT No.: PCT/EP01/12010

§ 371 (c)(1),
(2), (4) Date: Jan. 26, 2004

(87) PCT Pub. No.: WO03/010852

PCT Pub. Date: Feb. 6, 2003

(65) Prior Publication Data

US 2004/0196199 A1 Oct. 7, 2004

(30) Foreign Application Priority Data

Jul. 26, 2001 (DE) ..... 101 36 469

(51) Int. Cl.[7] ..... H01Q 1/28

(52) U.S. Cl. ..... 343/705; 343/767; 102/214; 244/3.14

(58) Field of Search ..... 343/705, 708, 343/767, 769, 770; 102/214, 211, 384; 244/3.14, 3.21, 3.22

(56) References Cited

U.S. PATENT DOCUMENTS

| | | | | |
|---|---|---|---|---|
| 4,305,078 | A | 12/1981 | Jones, Jr. et al. | 343/708 |
| 6,098,547 | A | 8/2000 | West | 102/214 |
| 6,307,514 | B1 * | 10/2001 | West | 343/705 |

* cited by examiner

*Primary Examiner*—Hoang V. Nguyen
(74) *Attorney, Agent, or Firm*—Scully, Scott, Murphy & Presser

(57) ABSTRACT

A slot antenna for the fuse of artillery ammunition, is provided through a sandwich structure in which an axially divided resonator ring chamber axially enclosed between upper and lower metallic cover discs profiled to be stable in respect of shape, is provided with a dielectric ring disc which extends with a peripherally extending color radially opposite a central cylindrical reflector wall through an axial slot between the two hollow-cylindrical outside walls of the ring chamber to the outer surface of the fuse casing which is also peripherally slit. In one of the two cover discs the inner edge of the antenna slot which opens into the ring space is defined by a hoop which is inserted into the front side of the outer wall and on which connecting locations which are displaced relative to each other in the peripheral direction are contacted through the dielectric ring disc and the axially oppositely disposed cover disc to a circuit carrier disc, where they are brought together in single-phase manner through a matching network to an antenna line, the second phase of which is connected to the cover disc adjacent thereto.

7 Claims, 3 Drawing Sheets

SLOT ANTENNA FOR ARTILLERY AMMUNITION

BACKGROUND OF THE INVENTION

1. Field of the Invention

The invention concerns an antenna, and is particularly directed to a disc-shaped slot antenna which is arranged transversely with respect to the longitudinal axis and concentrically in an artillery fuse.

2. Discussion of the Prior Art

An antenna of that kind is known for receiving satellite navigation information from U.S. Pat. No. 6,098,547 A in the structural form of a dielectric disc which is held transversely with respect to the axis of the system in the front region of an artillery fuse and which is metallically coated on both sides and which, for inductive adjustment of its resonance frequency, is provided with electrically conductive through passages, in parallel relationship with the axis, between the two metallisations. The adjustment options afforded by virtue of that arrangement however are really limited and are difficult to implement in terms of the practical demands. In particular however that antenna structure, either in itself or in terms of the apparatus integration options, does not have the desirable mechanical stability in relation to the acceleration forces which occur upon the launch of a spin-stabilised item of ammunition.

That applies in a corresponding manner to the axial stack, known from U.S. Pat. No. 4,305,078 A, of dielectric discs which are separated from each other by metallisation coatings, for forming a multi-frequency slot antenna through which axially passes the inner conductor of a coaxial antenna cable to a position for connection to the uppermost metallisation, with the outer conductor being connected to the oppositely disposed outer metallisation of the layer structure.

WO 99/02936 A2 discloses a droppable bomb which is provided at the centre of its tail with a sandwich-like or patch-like satellite antenna. During the dropping movement into the target area, the spherical characteristic thereof maintains contact with navigational satellites which are above the horizon in order to increase the hit accuracy by final phase control.

Such an antenna configuration is however inappropriate for artillery ammunition. For, the antenna directional characteristic which is oriented rearwardly from the tail antenna approximately symmetrically with respect to the longitudinal axis of the projectile would be directed, during the major part of the flight of an item of artillery ammunition along a more or less extended ballistic trajectory, only to the horizon, initially even therebelow and, after the apogee, only slightly thereabove. As a result, there would be a low level of probability of being able to simultaneously detect in a sufficiently trouble-free manner a number of navigational satellites, which would be sufficient for rapidly and precisely determining the point on the trajectory, for trajectory correction purposes. The installation of such a patch antenna in the tip of the projectile would also be unsatisfactory because its spherical characteristic which is then oriented coaxially forwardly would be directed markedly above the horizon only in the very first phase of the trajectory, but this is necessary in order to have contact with a plurality of satellites in a favourable configuration. After passing through the apogee the tip of an article of ammunition is then directed towards the ground again so that now at best it would be possible to pick up the very interference-afflicted ground reflections of satellite signals.

In addition, especially in the case of artillery ammunition, in view of the antenna characteristics which in practice are not ideally spherical in terms of axis symmetry, there is the problem of rotation for the purposes of spin stabilisation of ballistically launched projectiles or also only for the purposes of compensating for launch disturbances in the case of propulsion unit-accelerated and aerodynamically stabilised projectiles. For, the consequence of the antenna characteristic which is not circular in cross-section is that the signals are modulated in dependence on the rotational movement, and that severely adversely affects evaluation of the items of information which are thus communicated and therefore gives rise to a considerable increase in expenditure in terms of signal processing procedures.

Such rotationally-induced problems certainly occur when, in accordance with DE 44 01 315 A1, an unguided rocket, for GPS-aided trajectory correction by transverse thrust which if necessary is to be triggered in dependence on direction in space, is provided with a plurality of propulsion units which are strapped to the outside peripheral surface of the rocket body by clamping bands, in which respect at least one of those propulsion units is additionally equipped with a GPS antenna which is not described in greater detail therein. A trouble-free panoramic characteristic is not something to be expected from such an asymmetrical clamping band antenna configuration.

Comparable problems arise if, by means of the antenna, it is not items of information from satellites (such as items of positional information from navigational satellites) that are to be picked up and processed on board the ammunition, but rather if items of information are to be communicated from the ammunition by means of telemetry senders to geostationary or orbital receiving or relay stations.

SUMMARY OF THE INVENTION

In consideration of the aspects set forth hereinbefore, the technical object of the present invention is to provide a very high-frequency antenna which is suitable in terms of its mechanical and electrical properties for simple, also subsequent application to rolling artillery ammunition, in particular for satellite communication including navigation and telemetry in the L- and S-band.

In accordance with the invention that object is attained by the combination, recited in the main claim, of the essential features. In accordance therewith the slot antenna is again integrated into the ammunition body ogive with its unscrewable head fuse and thus can even only subsequently be applied without problem to the ammunition body. The axial position of the antenna depends on the frequency-dependent diameter and therefore, for receiving navigational satellites, it is displaced further towards the base, whereas for higher-frequency telemetry communication it is displaced further towards the tip of the fuse. The outer opening of the slot is disposed radially directly behind a slot which extends peripherally in the conical peripheral surface of the fuse. Then, extending therealong is an antenna characteristic which is toric in an axial symmetrical configuration so that, in spite of rotation about the longitudinal axis of the ammunition, there is always a segment of a level of sensitivity which remains practically constant, that detects the half-space above the horizon, without that requiring changeover switching procedures which are complicated and expensive in terms of circuitry and possibly cause electrical interference, as in the case of the adjusted antenna characteristic in accordance with EP 0 840 393 A2.

The antenna is again in the form of a disc-shaped but now extremely acceleration-resistant sandwich structure comprising metal turned parts with a resonator ring chamber which is concentric with respect to the cone axis and which opens opposite a cylindrical reflector wall with a radially peripherally extending radiator slot into the peripheral surface of the cone of the fuse. The ring chamber is divided transversely with respect to the longitudinal axis in its central plane or its plane of symmetry, so that here it is possible to insert a ring disc of a material which is as poor a conductor of electricity as possible and which has an increased dielectric constant, being distinguished by low dielectric losses and high creep current resistance, independently of frequency and temperature, like the fluorine-bearing polymer PTFE (polytetrafluoroethylene) which is available on the market under trade names such as Teflon, Fluon or Hostaflon. By means of the choice of material and the dimensioning of that ring disc, in accordance with the presetting of the geometrical dimensions of the ring chamber, it is also subsequently readily possible to effect electrical fine resonance tuning to for example a given satellite frequency. Preferably, apart from the actual ring chamber, the antenna slot which goes therearound extending radially therefrom is dielectrically filled, more specifically by a collar which extends flange-like in a peripheral configuration at the outside on the ring disc and which extends radially as far as the peripheral surface of the cone of the fuse.

Wiring of the antenna is effected by way of a two-wire antenna cable connected to at least two locations, which are disposed axially one in front of the other, of the inside edges of the slot. In order to produce an orthogonal dipole structure, four such connecting locations are provided at the corners of a notional square in concentric relationship with the fuse axis and are brought together by way of a matching network to the standardised impedance of a 50 ohm coaxial line to the antenna amplifier disposed rearwardly in the fuse.

At any event the invention provides a slot antenna which can be tuned without difficulty and which can be subjected to mechanically extreme loadings, for the fuse of artillery ammunition, by means of a sandwich structure in which an axially divided resonator ring chamber axially enclosed between upper and lower metallic cover discs profiled to be stable in respect of shape, is provided with a dielectric ring disc which extends with a peripherally extending collar radially opposite the central cylindrical reflector wall through an axial slot between the two hollow-cylindrical outside walls of the ring chamber to the outer surface of the fuse casing which is also peripherally slit. In one of the two cover discs the inner edge of the antenna slot which opens into the ring space is defined by a hoop which can be inserted into the front side of the outer wall and on which connecting locations which are displaced relative to each other in the peripheral direction are contacted through the dielectric ring disc and the axially oppositely disposed cover disc to a circuit carrier disc, whereupon they are brought together in single-phase manner by means of a matching network to an antenna line, the second phase of which is connected directly to the cover disc adjacent thereto.

BRIEF DESCRIPTION OF THE DRAWINGS

Additional developments and further features and advantages of the invention are set forth in the further claims and the description hereinafter of a preferred embodiment of the structure according to the invention, which is diagrammatically shown in the drawing, being limited to what is essential, in somewhat abstracted form but approximately true to scale. In the drawing:

DETAILED DESCRIPTION OF THE INVENTION

Figure 1:
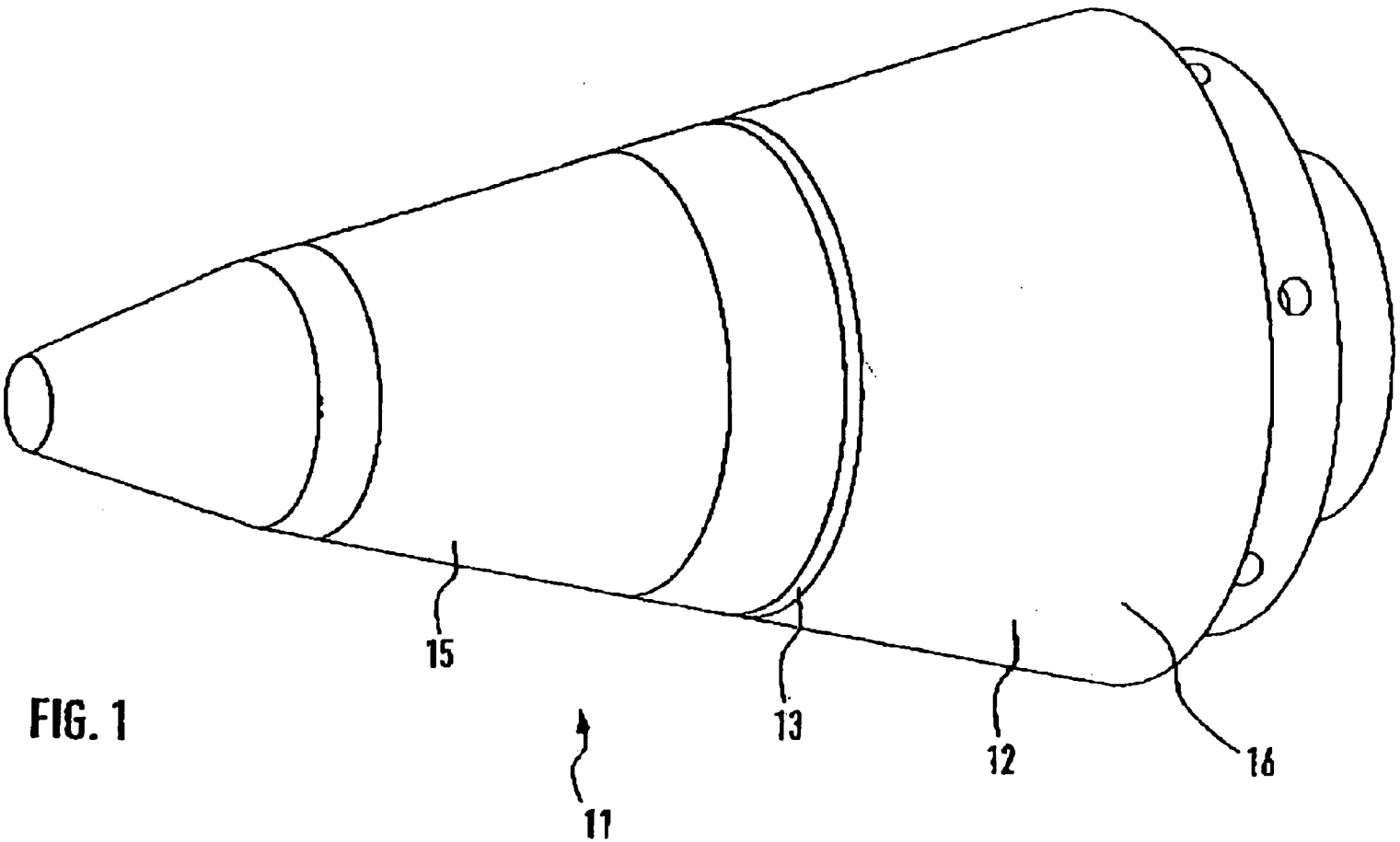
FIG. 1 is an isometric view of the fuse which can be applied to an item of artillery ammunition, with its antenna slot which in this embodiment is disposed between half the axial height and the base plane of the fuse and is filled with dielectric material.

The head fuse 11 shown in FIG. 1 is intended to be screwed by means of a screwthread (not shown) in front of the conically tapering front end of a spin-stabilised or aerodynamically stabilised item of artillery ammunition. It is provided with an antenna slot 13 which extends radially through its slightly cambered cone wall 12 therearound, the slot 13 being filled with dielectric material which terminates flush with the outside peripheral surface, which adjoins it axially on both sides, of the wall 12. Disposed in front of the radial plane of the slot 13, that is to say towards the tip of the front part 15 of the fuse, are mechanical or electromechanically operative safety and triggering devices of the fuse 11 and optionally aerodynamically operative braking devices for reducing the length of the trajectory, as described in the present applicants' earlier application Ser. No. 199 57 363.8 of 29 Nov. 1999 (to which reference is made herein in respect of the full content thereof to supplement the present disclosure of the invention in terms of a preferred situation of use of the slot antenna). Disposed behind the radial plane of the slot 13, that is to say towards the base of the rear part 16 of the fuse, are electrical circuits for antenna amplification and signal processing of the electromagnetic energy which is received or radiated by way of the slot 13 in the very high frequency spectrum.

Figure 2:
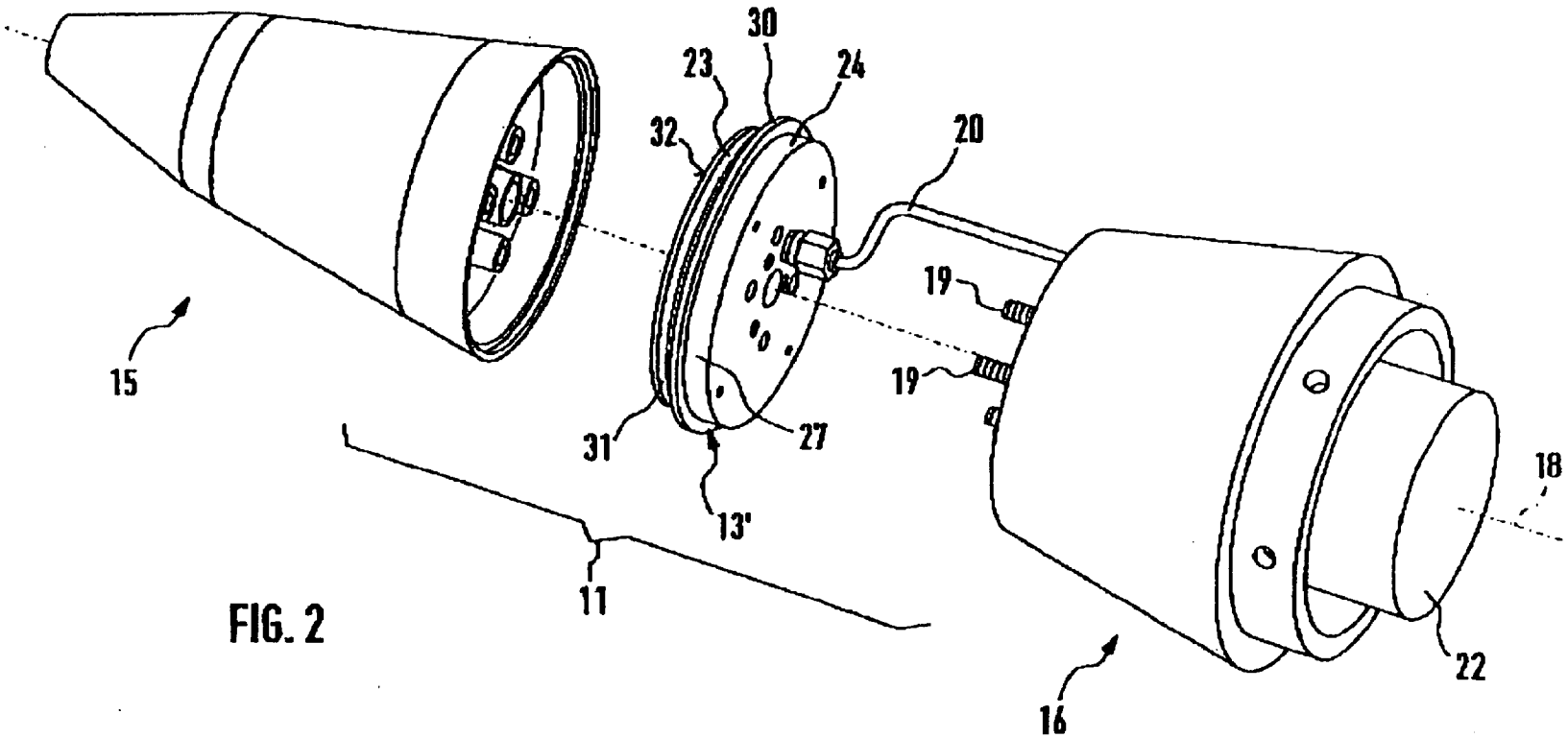
FIG. 2 is a view in the manner of an exploded illustration of the antenna which is axially clamped between the tip and the base of a fuse as shown in FIG. 1.

As diagrammatically shown in FIG. 2 the front part 15 of the fuse and the rear part 16 of the fuse are connected together with the axial interposition of the antenna 17 which can withstand extremely high mechanical loadings, by means of clamping screws 19 which extend parallel to the longitudinal axis 18 of the fuse and which extend through the antenna 17. A flexible antenna line 20 of coaxial cross-section leads to the antenna amplifier (not shown) disposed in the rear part 16 of the fuse. In the case of a receiving antenna this involves a pre-amplifier upstream of the receiver or signal processing circuit and in the case of a transmitting antenna this involves a power amplifier downstream of the processing circuit, which, like the power supply unit 22 thereof (for example in the form of an activatable battery or an afflux flow generator) is installed in the region of the base of the rear part 16 of the fuse.

Figure 3:
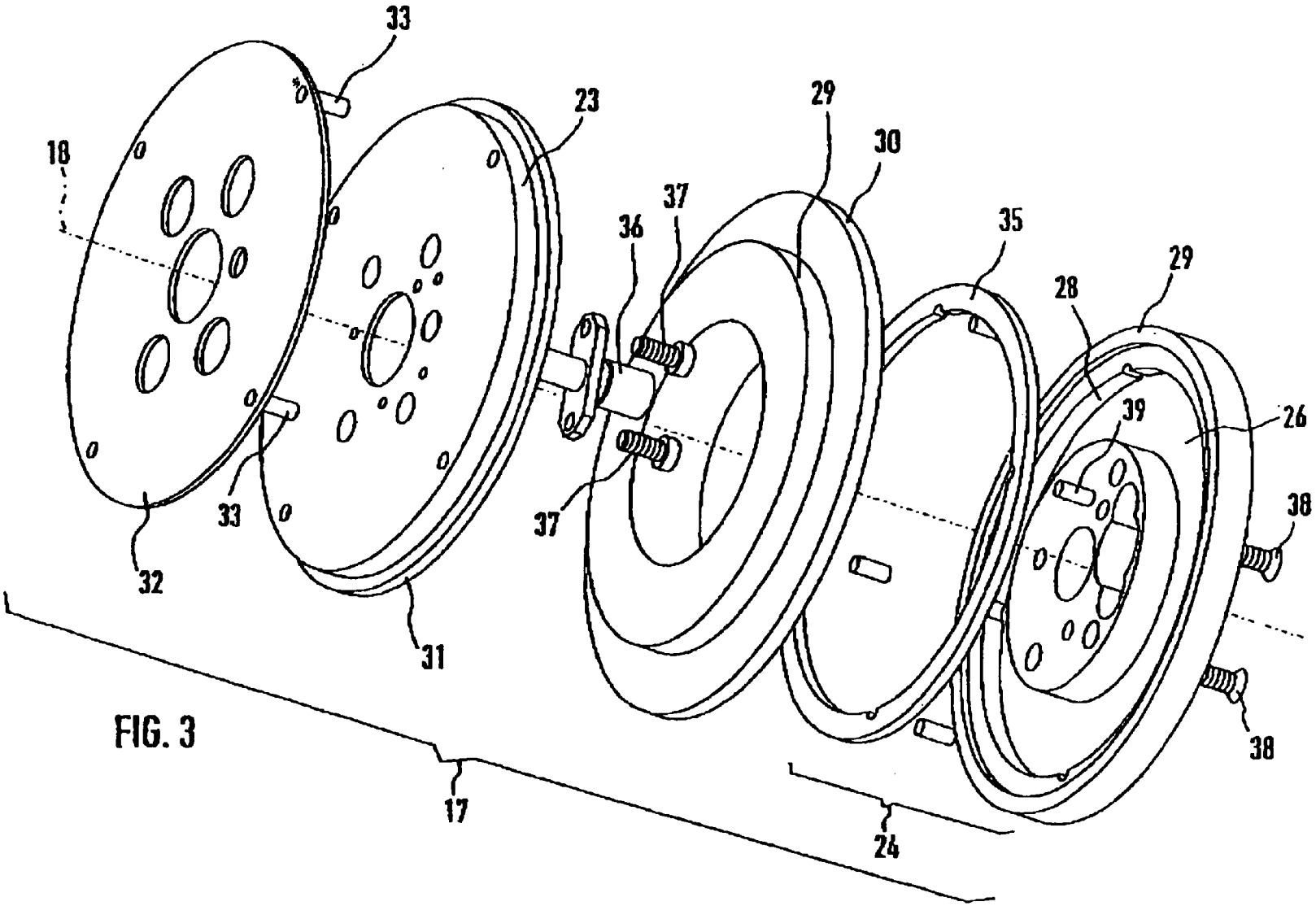
FIG. 3 is a view in the manner of an exploded illustration showing the mechanical sandwich structure of the antenna of FIG. 2.

It will be seen from the detail view in FIG. 3 that and how the disc-shaped antenna 17 is constructed in a sandwich-like fashion from torsionally stiff components. It substantially comprises two mechanically stiff metal cover discs, namely a metal upper disc 23 which is disposed towards the front part 15 of the fuse and which is of a shallow cup-shaped rotationally symmetrical profile in plate-like manner, and a metal lower disc 24 which is disposed in the opposite direction oriented towards the rear part 16 of the fuse and which is also of a shallow cup-shaped rotationally symmetrical profile configuration in plate-like manner—but in this case by way of example being in two parts for handling reasons for the connection of the antenna line. Each of those two discs 23–24 has a central stiffening means in the form of a base portion 25 which protrudes axially from the bottom 26 of the cup configuration between the walls 24 and 31 respectively. By virtue of that arrangement, defined radially between those base portions 25 and the hollow-cylindrical walls 27, 31 which extend peripherally at a spacing in relation thereto and axially between the bottoms 26 is a resonator ring chamber 28 which is approximately centrally divided transversely with respect to the longitudinal axis 18, insofar as, with axially mutually spaced end edges of the walls 27–31, the plate-shaped upper disc 23 bears with its base portion in electrically conductive relationship as it is flat thereagainst, axially against the face of the base portion 25 in the also plate-shaped lower disc 24. The axially mutually spaced end edges of the walls 27–31 define as between them, in radially opposite relationship to the cylindrical reflector wall of the base portion 25, the actual antenna slot 13' which extends radially from the ring chamber 28.

As therefore that ring chamber 28 is axially divided, a ring disc 29 of dielectric material can be inserted therein prior to fitting of the upper disc 23. The disc 29 has an externally radially peripherally extending collar 30 which projects in a flange-shaped configuration and of an axial thickness which is slightly smaller in comparison with the ring disc 29. The collar 30 extends radially with respect to the longitudinal axis 18 through the slot 13' which remains by virtue of the axial height of the base portion 25 between the mutually facing end faces of the walls 27 and 31 which externally enclose the ring chamber 28. The collar 30 preferably even also extends radially through the slot 13' into the slot 13 in the wall 12 between the front part 15 and the rear part 16 of the fuse, until terminating flush with the immediately adjacent outside peripheral surfaces. That facilitates assembly when axially fitting the front part 15 and the rear part 16 of the fuse together over the antenna 17 and here avoids turbulence in the region of the ogive of the body of the ammunition, which is particularly sensitive in terms of flow dynamics.

In the radial plane in front of the upper disc 23, that is to say towards the front part 15 of the fuse, the antenna 17 is fitted with a dielectric disc 32. That serves as a wiring carrier for the linking network between four mutually orthogonal connections to the inward end, which is towards the ring chamber 28, of the antenna slot 13'. For that purpose, four coaxial conductor portions 33 are anchored in parallel relationship with the longitudinal axis 18 of the system on the disc 32 at the corners of a notional square. The inner conductors pass through the annular disc 29 in order finally to end at a narrow electrically conductive hoop 35. The outer conductors are conductively connected to the upper disc 23 and to the underside of the circuit carrier disc 32. It is a component part of the two-part lower disc 23 and can be inserted into an end opening in the wall 31 thereof in such a way that it defines the rearward inner edge of the slot 13' which opens towards the annular chamber 28. Firstly however the inner conductor of the coaxial antenna line 20 is connected to that edge of the slot in the form of the hoop 35 when it is still removed from the lower disc 24, more specifically by way of the network provided on the circuit carrier disc 33, for bringing the four contact points which are respectively displaced relative to each other through 90° together at the peripherally extending slot 13' and by way of the conductor pins by means of a plug connection in the form of a coaxial plug socket 36. Thereafter the lower disc 24 is fitted from the rear over that hoop 35 which is thus already electrically connected through the dielectric ring disc 29 to the circuit carrier disc 32 in front of the upper disc 23.

The front inner edge of the slot which is in axially opposite relationship to the rearward edge is afforded by the inner end edge of the peripherally extending wall 31 of the upper disc 23. The electrical connection thereof to the outer conductor of the antenna line 20 is effected by the coaxial plug socket 36 for the antenna line 20, the ring disc 29 and the lower disc 24 being mounted eccentrically on to the inside of the bottom of the upper disc 23, by means of screws 37, extending therethrough in parallel relationship with the axis, towards the rear part 16 of the fuse, with play.

This sandwich structure for the antenna 17, which is shown in FIG. 3 and which is already in itself mechanically extremely stable, is axially braced together by means of screws 38 coaxially between the antenna lower disc 24 and upper disc 23, with the interposition of the collar 30 which engages radially through the hollow-cylindrical walls 26, 31, and as a result it is additionally torsionally stiff. Posts 39 which are mounted on at least one of the bottom base portions 25 and which extend through the ring disc 29 into the axially opposite disc 23 and 24 respectively serve as an assembly aid when the components are axially brought together and thereafter serves as a means for preventing relative rotational movement as between the upper disc 23 and the lower disc 24, that is to say serve to carry spin-induced rotational forces between those two parts of the cavity resonator of the slot antenna 17.

What is claimed is:

1. A disc-shaped slot antenna (17) arranged transversely with respect to the longitudinal axis (18) concentrically in a conical artillery fuse (11), characterised in that it has a resonator ring chamber (28) which is divided transversely with respect to the longitudinal axis (18) and which in radially opposite relationship to a central cylindrical reflector wall opens with a radially peripherally extending antenna slot (13') through the conical casing surface of the fuse (11) and into which is inserted a ring disc (29) of dielectric material having a collar (30) extending therearound in a flange-like configuration, of an axial thickness which is markedly smaller than the ring disc (29), the collar extending radially through the slot (13'), filling same, as far as the conical casing surface.

2. An antenna according to claim 1 characterised in that the collar (3O) terminates flush with the outside surface of the peripherally slotted (13) fuse wall (12).

3. An antenna according to claim 1 characterised in that the ring chamber (28) is provided between shallowly cup-shaped metallic discs (23–24) which are axially supported relative to each other over a large area with central base portions (25) protruding from the bottoms (26) of the discs, with an axial distance between their walls (27–31) which extend peripherally one in front of the other.

4. An antenna according to claim 1 characterised in that it is provided with a circuit carrier disc (32) which has a network for bringing together a plurality of connecting locations disposed along an inner edge of the slot (13') to a wire of an antenna line (20).

5. An antenna according to claim 4 characterised in that the inner edge of the slot (13') is provided by a hoop (35) which is inserted at the end face into one of hollow-cylindrical walls (27, 31) of the ring chamber (28).

6. An antenna according to claim 5 characterised in that the peripherally mutually displaced locations the hoop (35) is electrically conductively connected to the network on the circuit carrier disc (32) by conductor pins (33) which engage in parallel relationship with the axis through the ring disc (29) and the cover disc (23 or 24), disposed therebehind, of the ring chamber (28).

7. An antenna according to claim 6 characterised in that the ring chamber cover disc (23 or 24), outside which the circuit carrier disc (32) is arranged, is provided for the connection of an antenna line (20) with a plug socket (36) which is connected in a single-pole manner to the cover disc (23 or 24 respectively) and in single-pole manner to the network on the circuit carrier disc (32) disposed therebehind.

* * * * *